US008734165B2

(12) United States Patent
Neel

(10) Patent No.: US 8,734,165 B2
(45) Date of Patent: May 27, 2014

(54) QUICK CONNECTION DEVICE FOR ELECTRICAL APPLIANCE

(75) Inventor: Bruno Neel, Verneuil sur Seine (FR)

(73) Assignee: Schneider Toshiba Inverter Europe SAS, Pacy sur Eure (FR)

( * ) Notice: Subject to any disclaimer, the term of this patent is extended or adjusted under 35 U.S.C. 154(b) by 114 days.

(21) Appl. No.: 13/431,575

(22) Filed: Mar. 27, 2012

(65) Prior Publication Data

US 2012/0282786 A1 Nov. 8, 2012

(30) Foreign Application Priority Data

May 4, 2011 (FR) ..... 11 53815

(51) Int. Cl.
*H01R 11/30* (2006.01)

(52) U.S. Cl.
USPC ..... 439/39

(58) Field of Classification Search
USPC ..... 439/39, 42
See application file for complete search history.

(56) References Cited

U.S. PATENT DOCUMENTS

| | | | | |
|---|---|---|---|---|
| 3,521,216 | A | 7/1970 | Tolegian | |
| 5,933,328 | A * | 8/1999 | Wallace et al. | 361/737 |
| 6,193,557 | B1 * | 2/2001 | Luvini et al. | 439/630 |
| 6,869,302 | B2 * | 3/2005 | Bricaud et al. | 439/326 |
| 6,896,548 | B2 * | 5/2005 | Scuteri et al. | 439/541.5 |
| 7,059,912 | B2 * | 6/2006 | Tsai | 439/630 |
| 7,083,473 | B1 * | 8/2006 | Lai | 439/630 |
| 7,309,259 | B2 * | 12/2007 | Sun et al. | 439/630 |
| 7,322,838 | B1 * | 1/2008 | Chen et al. | 439/159 |
| 7,326,085 | B2 * | 2/2008 | Takai et al. | 439/630 |
| 7,351,109 | B2 * | 4/2008 | Wang | 439/631 |
| 7,357,643 | B1 * | 4/2008 | Chen et al. | 439/65 |
| 7,390,204 | B2 * | 6/2008 | Tanaka et al. | 439/159 |
| 7,442,044 | B2 * | 10/2008 | Yang et al. | 439/64 |
| 7,448,889 | B1 * | 11/2008 | Ho et al. | 439/159 |
| 7,452,241 | B2 * | 11/2008 | Kikuchi et al. | 439/630 |
| 7,618,273 | B1 * | 11/2009 | Wang et al. | 439/159 |
| 7,625,213 | B1 * | 12/2009 | Tse | 439/39 |
| 7,976,327 | B2 * | 7/2011 | Matsumoto et al. | 439/326 |

(Continued)

FOREIGN PATENT DOCUMENTS

| | | |
|---|---|---|
| EP | 1 865 581 A2 | 12/2007 |
| FR | 2 865 573 | 7/2005 |
| GB | 2 414 603 | 11/2005 |
| WO | WO 2007/053871 A1 | 5/2007 |

OTHER PUBLICATIONS

French Preliminary Search Report and Written Opinion issued Nov. 7, 2011, in French 1153815, filed May 4, 2011 (with English Translation of Categories of Cited Documents).

*Primary Examiner* — Alexander Gilman
(74) *Attorney, Agent, or Firm* — Oblon, Spivak, McClelland, Maier & Neustadt, L.L.P.

(57) ABSTRACT

The invention relates to an electrical connection device (2) suitable for being connected to an electrical apparatus (1) furnished with one or more screw or elastic electrical terminals (10). The device comprises one or more connectors (20, 21) each designed to be connected directly to one of the one or more electrical connection terminals, and each connector (20, 21) comprises a permanent magnet (200, 210) designed to be magnetized on the said electrical terminal (10) when the connector (20, 21) is brought near to the terminal (10). The device of the invention makes it possible to make a rapid connection of the conductors on each screw or elastic electrical terminal (10) of the electrical apparatus.

10 Claims, 2 Drawing Sheets

(56) References Cited

U.S. PATENT DOCUMENTS

| | | | | |
|---|---|---|---|---|
| 8,107,246 | B2 * | 1/2012 | Fidalgo et al. | 361/737 |
| 8,157,596 | B1 * | 4/2012 | Little et al. | 439/630 |
| 8,282,404 | B1 * | 10/2012 | Little et al. | 439/95 |
| 8,337,223 | B2 * | 12/2012 | Gao et al. | 439/159 |
| 8,337,239 | B2 * | 12/2012 | Holmes | 439/483 |
| 2002/0076954 | A1 * | 6/2002 | Chen et al. | 439/76.1 |
| 2003/0081388 | A1 * | 5/2003 | Yang | 361/737 |
| 2005/0003711 | A1 * | 1/2005 | Chang | 439/630 |
| 2005/0164564 | A1 | 7/2005 | Kawata et al. | |
| 2005/0196994 | A1 * | 9/2005 | Bilcauu et al. | 439/326 |
| 2007/0287302 | A1 | 12/2007 | Lindberg et al. | |
| 2009/0111287 | A1 * | 4/2009 | Lindberg et al. | 439/39 |

* cited by examiner

QUICK CONNECTION DEVICE FOR ELECTRICAL APPLIANCE

TECHNICAL FIELD OF THE INVENTION

The present invention relates to a rapid connection device used on an electrical apparatus.

DESCRIPTION OF THE PRIOR ART

When an electrical apparatus, such as for example a contactor, a circuit breaker or a variable speed drive must be tested, each power-supply conductor must be connected individually to the terminals of the electrical apparatus. When these terminals are screw or even elastic terminals, the duration necessary for the connection of the conductors to each terminal may prove to be particularly long. This duration increases the larger the number of items of apparatus to be tested.

Document EP1865581 describes a connector incorporating a magnet so as to be able to make it easier to connect it to an electronic apparatus.

Document U.S. Pat. No. 7,625,213 describes acoustic enclosures that can be assembled together by using magnets.

Document WO2007053871 describes a circuit breaker apparatus furnished with tool-free connection terminals.

The object of the invention is to propose an electrical connection device for an electrical apparatus furnished with screw or elastic terminals that makes it possible for it to be rapidly connected to the screw or elastic terminals of the apparatus.

DESCRIPTION OF THE INVENTION

This object is achieved by an electrical connection device suitable for being connected to an electrical apparatus furnished with one or more screw or elastic electrical terminals, characterized in that the device comprises one or more connectors each designed to be connected directly to one of the one or more electrical connection terminals, and in that each connector comprises a permanent magnet designed to magnetize the connector on the said electrical terminal when the connector is brought near to the terminal.

According to a particular feature, the connector comprises a sleeve inside which the permanent magnet is inserted.

According to another particular feature, the connector comprises a spring mounted between the permanent magnet and the sleeve.

According to another particular feature, the connector comprises an electrically conductive element connected directly to the permanent magnet.

According to another particular feature, the sleeve is made of an electrically conductive material and the connector comprises an actuation member that can move in translation relative to the sleeve, the said actuation member being made of an electrically insulating material and being arranged to accommodate the permanent magnet.

According to another particular feature, the actuation member comprises a head designed to be interposed between the electrical terminal and the permanent magnet when the connector is connected to the electrical terminal.

According to another particular feature, the connector comprises an auxiliary contact system arranged on the actuation member and on a portion that is fixed relative to the actuation member.

According to another particular feature, the connector comprises a body made of insulating material covering the sleeve.

According to another particular feature, the device comprises several adjacent connectors attached together and separated at a distance corresponding to an inter-terminal distance of the electrical apparatus.

According to another particular feature, each connector comprises male and female coupling means on its body capable of interacting with matching coupling means made on a body of an adjacent connector.

BRIEF DESCRIPTION OF THE FIGURES

Other features and advantages will appear in the following detailed description given with reference to an embodiment given as an example and represented by the appended drawings in which.

DETAILED DESCRIPTION OF AT LEAST ONE EMBODIMENT

Figure 1:
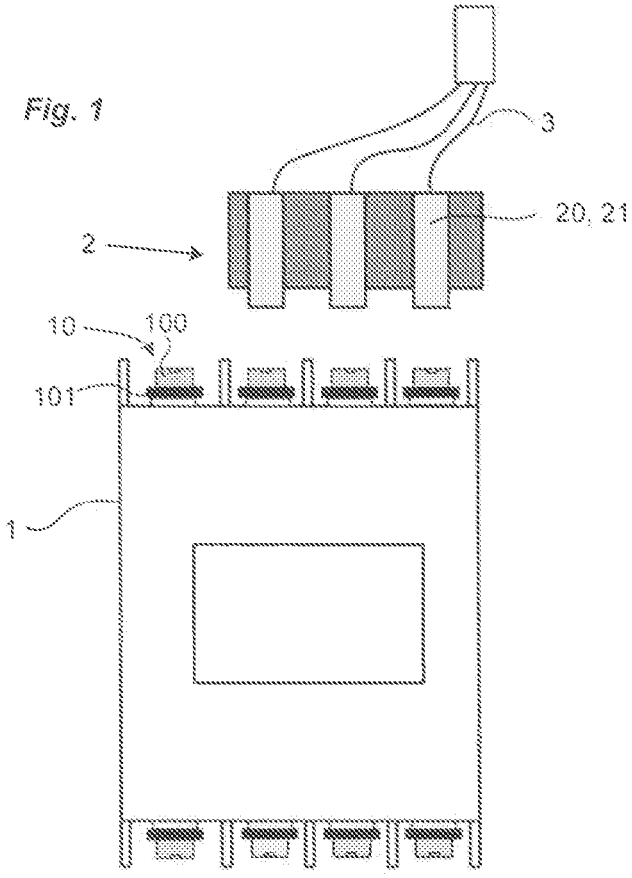
FIG. 1 represents an electrical apparatus of the electromechanical contactor type and the connection device of the invention.

In a known manner, an electrical apparatus 1 comprises several screw or elastic electrical terminals 10 to each of which a conductor 3 can be connected using an eye terminal. In a screw terminal, the eye terminal is tightened by a screw 100 in a yoke 101. In an elastic terminal (not shown), the end of the conductor 3 is inserted into an elastic cage. An electrical apparatus 1 of the electromechanical contactor type comprises notably three input terminals and three output terminals connected to the power and two terminals for controlling the electromagnet situated inside the contactor. In FIG. 1, the contactor is shown with screw electrical terminals 10.

When the electrical apparatus must be tested, each of its electrical terminals 10 must be connected to a conductor. The device of the invention makes it possible to make a rapid connection of the conductors to each screw or elastic electrical terminal 10 of the electrical apparatus.

For this, the connection device 2 of the invention comprises at least one connector 20, 21 furnished with a permanent magnet 200, 210 making it possible for the connector to be magnetized directly on the electrical terminal, for example on the screw for a screw electrical terminal 10. According to the invention, the permanent magnet 200, 210 is not used simply to guide a connector 20, 21 to its normal connection location but is used to connect the conductor 3 to an electrical terminal 10 in a different way from that normally provided by the terminal.

With reference to FIG. 1, each connector 20, 21 is therefore magnetized on an electrical terminal 10 of the electrical apparatus. The connectors 20, 21 may be assembled together in order to form a connection block making it possible in a single action to connect several terminals simultaneously (FIG. 1).

Figure 2:
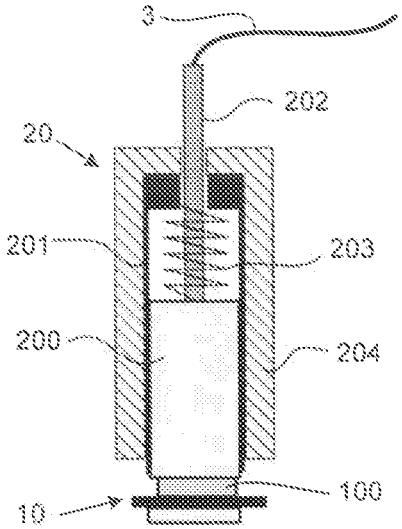
FIG. 2 represents a first variant embodiment of a connector used for the connection device of the invention.

With reference to FIG. 2, a first variant embodiment of a connector 20 used in the device comprises for example a sleeve 201 made of insulating material inside which the permanent magnet 200 is housed. The connector 20 may also comprise a conductive element 202 connected directly to the permanent magnet 200 and to the conductor 3. In this manner, the electric current passes through the conductive element 202 and through the permanent magnet 200. The connector 20 may also comprise a spring 203 of the coil type positioned between the magnet 200 and a top portion of the sleeve 201, and a body 204 made of insulating material covering the sleeve 201 and allowing the connector 20 to be gripped. This architecture is suitable for low currents, for example below four amperes. During the connection to an electrical terminal 10, the connector 20 is magnetized on the terminal 10 by its permanent magnet 200 which then conveys the electric current itself.

Figure 3A:
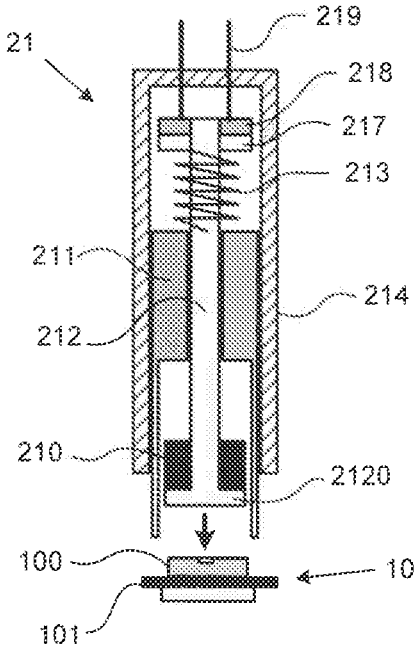
FIGS. 3A and 3B represent a second variant embodiment of a connector used for the connection device of the invention, respectively disconnected and connected to a screw electrical terminal.
Figure 3B:
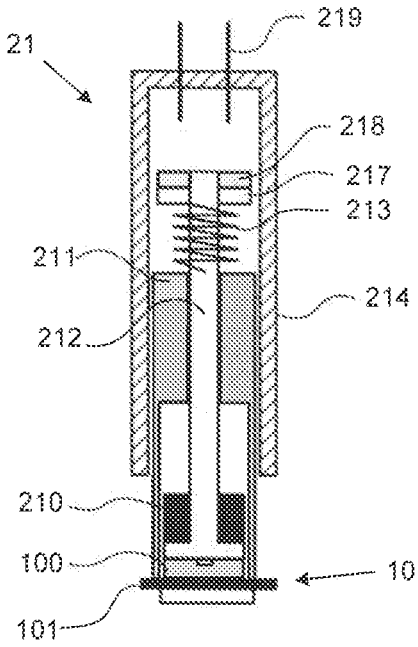

For the high currents, between four and seventy amperes, a second variant embodiment of the connector 21 used in the device of the invention comprises a sleeve 211 made of electrically conductive material designed to be connected to the conductor 3 (not shown in FIGS. 3A and 3B). With reference to FIGS. 3A and 3B, the connector 21 also comprises an actuation member 212 that can be moved in translation relative to the sleeve 211 and a permanent magnet 210 attached to the actuation member 212. This actuation member 212 is made of an electrically insulating material. More precisely, the actuation member 212 comprises at its bottom end a head 2120 furnished with a bearing surface designed to come into contact with the head of the screw and a surface opposite to the said bearing surface on which the permanent magnet is placed. In this configuration, the permanent magnet does not come into direct contact with the screw 100 of the electrical terminal 10, which makes it possible to prevent a demagnetization of the permanent magnet 210 when the current is particularly high. The connector 21 also comprises a spring 213 of the coil type positioned between the sleeve 211 and a first nut 217 made of electrically insulating material screwed onto the top end of the actuation member 212. The conductor 21 may comprise an auxiliary contact system comprising for example two conductors 219 and a second nut 218 made of electrically conductive material screwed onto the actuation member 212, above the first nut 217. When the connector 21 is disconnected from the electrical terminal 10, the second nut 218 makes the electrical contact between the two conductors 219 (FIG. 3A). When the connector 21 is connected to the electrical terminal 10, the electrical contact is broken (FIG. 3B). This system ensures good mechanical operation of the connector 21 before connection to the electrical terminal 10.

In this second variant embodiment, the current therefore passes through the sleeve 211. During the connection to the electrical terminal 10, the actuation member 212 is pressed against the head of the screw 100 by the action of the permanent magnet 210. By virtue of the combined action of the permanent magnet 210 and the spring 213, the sleeve 211 is then pressed onto the surface of the yoke 101 situated under the head of the screw 100 (FIG. 3B) and on the periphery of the head of the screw. The connector 21 may comprise a body 214 made of insulating material covering the conductive sleeve 211. The size of the sleeve 211 may vary from one connector 21 to another in order to suit the size of the electrical terminal 10 of the electrical apparatus.

Figure 4:
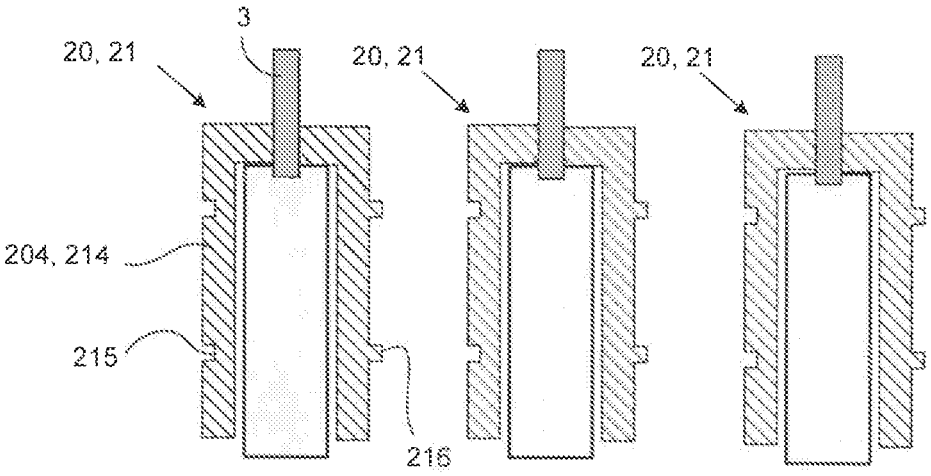
FIG. 4 represents an advantageous embodiment of the connection device of the invention.

From one electrical apparatus 1 to another, the inter-terminal distances may vary. It is therefore useful to provide connectors 20, 21 that can be adapted to the various electrical terminals which vary in size and in type. With reference to FIG. 4, the connection device 2 may consist of a modular assembly in which the connectors 20, 21 may be assembled to one another in order to suit the number of terminals of the electrical apparatus 1 and the inter-terminal distance of the electrical apparatus 1. The body 204, 214 made of insulating material of a connector 20, 21 may thus comprise female coupling members 215 capable of accommodating male coupling members 216 of an adjacent identical connector and male coupling members 216 capable of being engaged in female coupling members 215 of an adjacent identical connector. The bodies 204, 214 of each connector 20, 21 may be of different sizes in order to fit the configuration of the apparatus.

The invention is of particular value for the electrical connection of the items of electrical apparatus 1 when they are tested or configured at the factory.

The invention claimed is:

1. An electrical connection device suitable for being connected to an electrical apparatus furnished with one or more screw or elastic electrical terminals, the electrical connection device comprising:

one or more connectors each configured to be connected directly to one of the one or more electrical terminals, each connector including a permanent magnet configured to magnetize the respective connector on the respective electrical terminal when the respective connector is brought near to the electrical terminal, and including a sleeve inside which the permanent magnet is inserted, wherein a connector of the one or more connectors includes an actuation member configured to move in translation relative to the sleeve, the actuation member being made of an electrically insulating material and being arranged to accommodate the permanent magnet.

2. The electrical connection device according to claim 1, wherein a second connector of the one or more connectors includes a spring mounted between the permanent magnet and the sleeve.

3. The electrical connection device according to claim 1, wherein a second connector of the one or more connectors includes an electrically conductive element connected directly to the permanent magnet.

4. The electrical connection device according to claim 1, wherein the sleeve of the connector is made of an electrically conductive material.

5. The electrical connection device according to claim 4, wherein the actuation member includes a head that is interposed between the electrical terminal and the permanent magnet when the connector is connected to the electrical terminal.

6. The electrical connection device according to claim 4, wherein the connector includes an auxiliary contact system arranged on the actuation member and on a portion that is fixed relative to the actuation member.

7. The electrical connection device according to claim 1, wherein the connector includes a body made of an insulating material covering the sleeve.

8. The electrical connection device according to claim 7, further comprising additional adjacent connectors attached together and separated at a distance corresponding to an inter-terminal distance of the electrical apparatus.

9. The electrical connection device according to claim 8, wherein a body of each of the additional adjacent connectors includes male and female coupling means configured to interact with matching coupling means made on a body of an additional adjacent connector.

10. An electrical connection device suitable for being connected to an electrical apparatus furnished with a screw or elastic electrical terminal, the electrical connection device comprising:

a connector that connects directly to the electrical terminal, the connector including a permanent magnet that magnetizes the connector on the electrical terminal when the connector is brought near to the electrical terminal, a sleeve that houses the permanent magnet, and a body, the body being made of an insulating material and covering the sleeve, the body including male and female coupling members that interact with matching coupling members included on a body of an adjacent connector.

* * * * *